US010036224B2

(12) United States Patent
Borak

(10) Patent No.: US 10,036,224 B2
(45) Date of Patent: Jul. 31, 2018

(54) SEAL LOCK DOWN

(71) Applicant: GE Oil & Gas Pressure Control LP, Houston, TX (US)

(72) Inventor: Eugene Allen Borak, Houston, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 824 days.

(21) Appl. No.: 14/482,847

(22) Filed: Sep. 10, 2014

(65) Prior Publication Data

US 2016/0069149 A1 Mar. 10, 2016

(51) Int. Cl.

| | |
|---|---|
| ***E21B 33/03*** | (2006.01) |
| ***E21B 33/038*** | (2006.01) |
| ***E21B 33/04*** | (2006.01) |
| *E21B 33/00* | (2006.01) |

(52) U.S. Cl.

CPC ..... *E21B 33/03* (2013.01); *E21B 33/038* (2013.01); *E21B 33/04* (2013.01); *E21B 2033/005* (2013.01)

(58) Field of Classification Search

CPC .. E21B 33/03; E21B 33/038; E21B 2033/005; E21B 33/04

See application file for complete search history.

(56) References Cited

U.S. PATENT DOCUMENTS

| | | | | |
|---|---|---|---|---|
| 5,174,376 | A | 12/1992 | Singeetham | |
| 5,307,879 | A | 5/1994 | Kent | |
| 8,186,426 | B2 | 5/2012 | Nelson | |
| 8,387,708 | B2 | 3/2013 | Anderson et al. | |
| 2010/0300705 | A1* | 12/2010 | Nelson | E21B 33/04 166/387 |
| 2013/0299193 | A1* | 11/2013 | Duong | E21B 33/04 166/382 |
| 2016/0040499 | A1* | 2/2016 | Cain | E21B 19/00 166/382 |

OTHER PUBLICATIONS

International Search Report and Written Opinion issued in connection with corresponding PCT Application No. PCT/US2015/049365 dated Jan. 28, 2016.

* cited by examiner

*Primary Examiner* — Giovanna C. Wright
*Assistant Examiner* — Tara E Schimpf
(74) *Attorney, Agent, or Firm* — Hogan Lovells US LLP

(57) ABSTRACT

A wellhead assembly includes an outer wellhead member, the outer wellhead member having a locking profile on an inner surface. An inner tubular wellhead member lands within the outer wellhead member, defining a seal pocket between the inner tubular wellhead member and the outer wellhead member. A seal ring is located in the seal pocket. A seal energizing ring urges the seal ring into sealing engagement with the outer wellhead member and the inner tubular wellhead member. An annular lock ring is carried with the seal energizing ring and engages the locking profile. A lock energizing ring retains the annular lock ring in engagement with the locking profile.

20 Claims, 4 Drawing Sheets

SEAL LOCK DOWN

BACKGROUND

1. Field of the Disclosure

The present invention relates in general to subterranean wells, and in particular to a seal with an energizing ring and a retention assembly, for sealing between wellhead members.

2. Description of Prior Art

In hydrocarbon production wells, a housing such as a wellhead housing or high pressure housing is located at the upper end of the well. The wellhead housing is a large tubular member having an axial bore extending through it. An tubular inner wellhead member, such as casing and other conductor pipes, will extend into the well and will be secured in place. A hanger, which can be, for example, a slips style hanger assembly, will land within the wellhead housing and can support the inner tubular wellhead member. The exterior of the inner tubular wellhead member is spaced from the bore of the wellhead housing by an annular clearance which provides a pocket for receiving an annulus seal.

There are many types of annulus seals, including rubber, rubber combined with metal, and metal-to-metal. One metal-to-metal seal in use has a U-shape in cross section, having inner and outer walls or legs separated from each other by an annular clearance, called a seal pocket. A seal energizing ring is pressed into the seal pocket to force the legs apart and into sealing engagement with the bore and with the exterior of the casing hanger.

During operations, thermal expansion of the inner wellhead member can cause the upper end of the inner wellhead member to lift upwards, backing the energizing ring out of the seal pocket. Because of the grip of the slips, the inner wellhead member is unable to move downwards and back to its intended position. In addition, cyclic loads and pressures can cause the energizing ring to back away from the annulus seal. This backing out of the seal energizing ring, can cause the seal ring to leak.

SUMMARY OF THE DISCLOSURE

Methods and systems of embodiments of the current disclosure provide a system and method for locking down the inner wellhead member and the seal energizing ring so that the integrity of the seal ring is retained. The transfer of inner wellhead member load due to thermal expansion is transferred to the wellhead housing by way of a metal to metal seal with a U-shaped cross section that has no self locking feature. This load is instead transferred to the seal energizing ring and on to a lock energizing ring and into an independent lock ring. The lock ring retains both the pressure load and thermal expansion load associated with the inner wellhead member.

In an embodiment of this disclosure, a wellhead assembly includes an outer wellhead member, the outer wellhead member having a locking profile on an inner surface. An inner tubular wellhead member lands within the outer wellhead member, defining a seal pocket between the inner tubular wellhead member and the outer wellhead member. A seal ring is located in the seal pocket. A seal energizing ring urges the seal ring into sealing engagement with the outer wellhead member and the inner tubular wellhead member. An annular lock ring is carried with the seal energizing ring and engages the locking profile. A lock energizing ring retains the annular lock ring in engagement with the locking profile.

In an alternate embodiment of the current disclosure, a wellhead assembly includes an outer wellhead member, the outer wellhead member having a locking profile on an inner surface. An inner tubular wellhead member lands within the outer wellhead member, defining a seal pocket between the inner tubular wellhead member and the outer wellhead member. A seal ring is located in the seal pocket, the seal ring having a U-shaped crossed section with an inner leg and an outer leg. A seal energizing ring has an end selectively located between the inner leg and the outer leg of the seal ring, urging the outer leg into sealing engagement with the outer wellhead member and urging the inner leg into engagement with the inner tubular wellhead member. An annular gland circumscribes a portion of the seal energizing ring. A lock energizing ring circumscribes a portion of the seal energizing ring. An annular lock ring is located axially between an upper end surface of the annular gland and a sloped surface of the lock energizing ring. The annular lock ring selectively engages the locking profile, transferring axial forces of the inner tubular wellhead member to the outer wellhead member.

In another alternate embodiment of this disclosure, a method for forming a seal between an inner tubular wellhead member and an outer wellhead member includes positioning an annular seal ring in an annulus between the inner tubular wellhead member and the outer wellhead member. The annular seal ring is energized by urging the annular seal ring toward the outer wellhead member and the inner tubular wellhead member with a seal energizing ring. A lock energizing ring is rotated to engage an annular lock ring with a locking profile located on an inner surface of the outer wellhead member.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION OF THE DISCLOSURE

Figure 1:
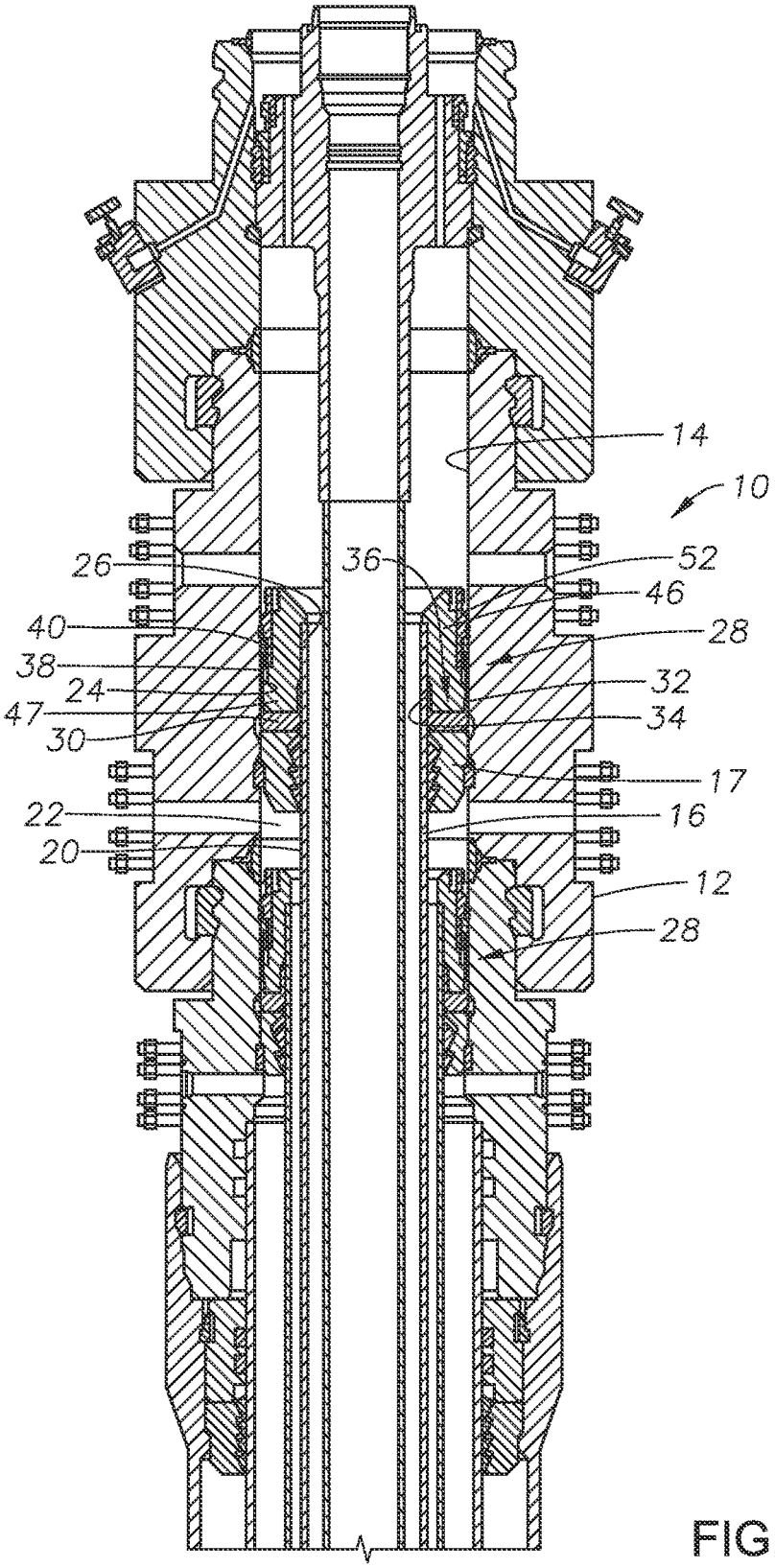
FIG. 1 is a section view of an embodiment of a multi-bowl wellhead system with multiple seal assemblies of embodiments of this disclosure, positioned in an annulus between a wellhead housing and an inner tubular wellhead member.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 3:
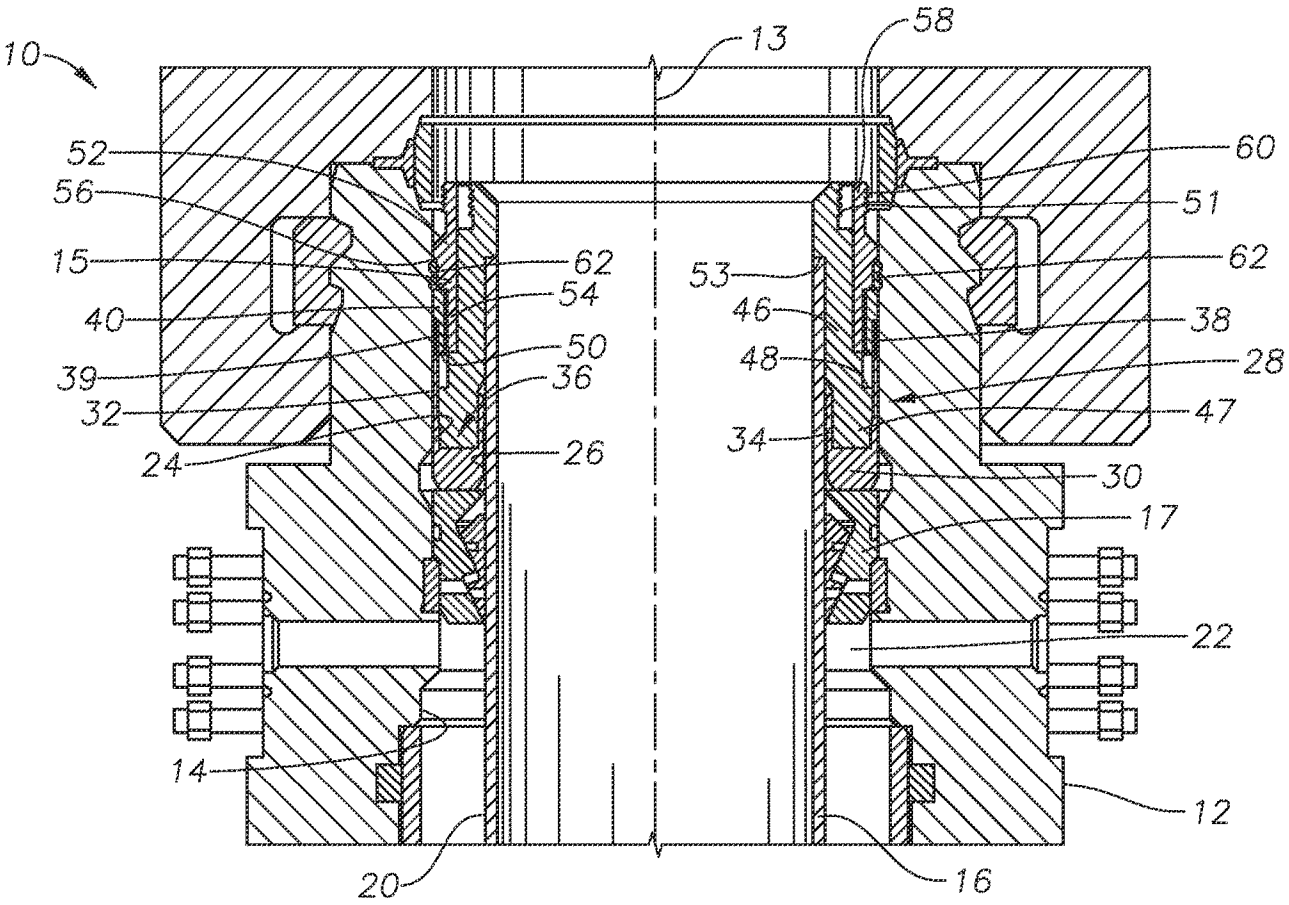
FIG. 3 is a section view of one of the seal assemblies of FIG. 1, positioned in an annulus between a housing and an inner tubular wellhead member, shown with the annular lock ring in an energized position.

Referring to FIGS. 1 and 3, wellhead assembly 10 is shown. Wellhead assembly 10 includes outer wellhead member 12, such as a wellhead housing. In the illustrated embodiment, outer wellhead member 12 is a conventional high pressure housing for a subsea well or a surface well. Outer wellhead member 12 is a large tubular member located at the upper end of the well. Outer wellhead member 12 has axis 13 and axial bore 14 extending through outer wellhead member 12. Outer wellhead member 12 has locking profile 15 on an inner surface. Locking profile 15 can be, for example, annular grooves.

Inner tubular wellhead member 16, such as a casing or other conductor pipe, lands in outer wellhead member 12. Inner tubular wellhead member 16 is a tubular conduit secured within outer wellhead member 12. In the example of FIGS. 1 and 3, inner tubular wellhead member 16 is secured within outer wellhead member 12 with slips assembly 17. The radially outer wall 20 of inner tubular wellhead member 16 is generally parallel to the wall of bore 14 but spaced radially inward. This results in an annular clearance or seal pocket 22 between outer wall 20 of inner tubular wellhead member 16 and the wall of bore 14 of outer wellhead member 16.

Outer wellhead sealing surface 24 is located on an inner diameter of outer wellhead member 12, which is the wall of bore 14. Inner member sealing surface 26 is located on radially outer wall 20 of inner tubular wellhead member 16, radially across bore 14 from outer wellhead sealing surface 24. As one of skill in the art will appreciate, outer wellhead sealing surface 24 and inner member sealing surface 26 can have any of a variety of surfaces such as a generally smooth surface, a texture that enhances friction while maintaining a seal, or wickers. Wickers are grooves defined by parallel circumferential ridges and valleys. Wickers are not threads. The sealing surfaces 24, 26 shown in the example of FIGS. 1 and 3 are smooth.

Referring to FIGS. 1-4, a seal assembly 28 lands in seal pocket 22 between radially outer wall 20 and the wall of bore 14. In the embodiment of FIG. 1, two seal assemblies 28 are shown and in other embodiments, more or less than two seal assemblies 28 can be used in wellhead assembly 10. Referring again to FIGS. 1-4, seal assembly 28 is made up entirely of metal components or a combination of metal and non-metal components. These components include seal ring 30 which is annular and has a general U-shape in cross section. Seal ring 30 has an outer wall or leg 32 and a parallel inner wall or leg 34. Outer leg 32 circumscribes a portion of inner leg 34. Outer leg 32 and inner leg 34 are connected together at the bottom by a base, and open at the top. The inner diameter of outer leg 32 is radially spaced outward from the outer diameter of inner leg 34. This results in an annular clearance 36 between outer leg 32 and inner leg 34.

Figure 4:
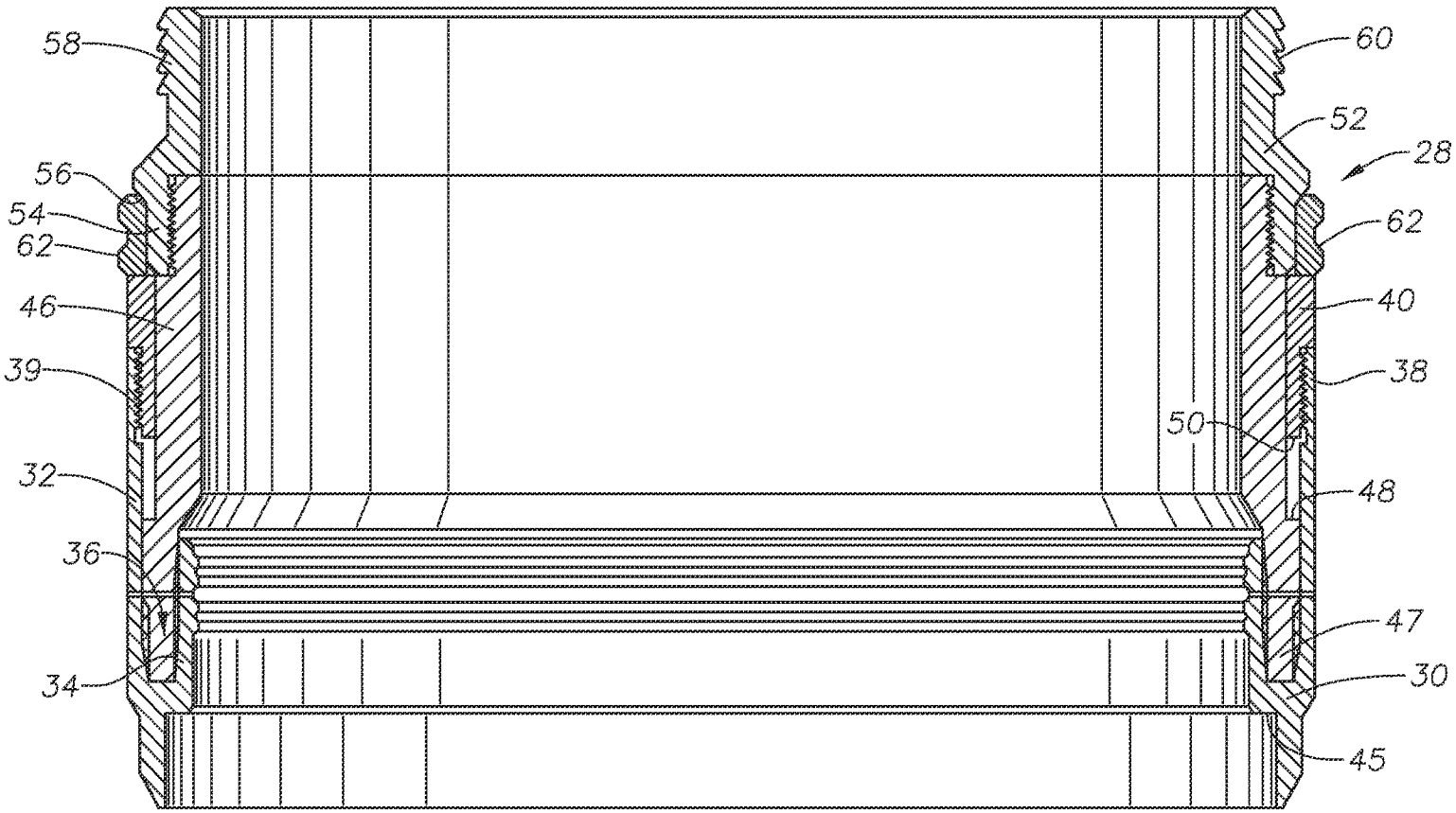
FIG. 4 is a section view of a seal assembly of another embodiment of this disclosure, shown with the annular lock ring in an energized position.

Outer leg 32 of seal ring 30 has an extended portion 38 that extends axially upward beyond the inner leg. In an example embodiment, annular gland 40 is a nut that is releasably connected to an upper end of seal ring 30, at extended portion 38 of outer leg 32. Annular gland 40 has a lower portion with a decreased wall thickness. The lower portion of annular gland 40 has threads 39 on an outer diameter and is threaded to the upper end of seal ring 30. An upper portion of retainer 40 has an outer diameter that is substantially similar to the outer diameter of outer leg 32 of seal ring 30. In the embodiment of FIG. 4, seal ring 30 has a downward facing shoulder 45 that can engage an upward facing shoulder of inner wellhead member 16 or of a hanger associated with inner wellhead member 16.

Returning to FIGS. 1-4, seal energizing ring 46 selectively urges seal ring 30 into sealing engagement with outer wellhead member 12 and inner tubular wellhead member 16. Seal energizing ring 46 has a lower end 47 insertable between inner and outer legs 32, 34 of seal ring 30, so that when lower end 47 of seal energizing ring 46 is inserted between inner and outer legs 32, 34 of seal ring 30, inner leg 32 of seal ring 30 is urged radially into sealing engagement with inner tubular wellhead member 16 and outer leg 34 of seal ring 30 is urged radially into sealing engagement with outer wellhead member 12.

In embodiments having wickers, the wickers of each sealing surface 24, 26 bite into inner and outer legs 32, 34 of seal ring 30, respectively. Seal energizing ring 46 has an outer diameter that will frictionally engage the inner diameter of outer leg 34. Seal energizing ring 46 has an inner diameter that will frictionally engage the outer diameter of inner leg 32. The radial thickness of lower end 47 of seal energizing ring 46 is greater than the initial radial dimension of annular clearance 36. Seal energizing ring 46 has an upward facing shoulder 48 on an outer diameter that can mate with a bottom surface 50 of annular gland 40 during the installation of seal assembly 28 in seal pocket 22, so that seal energizing ring 46 is retained as a part of seal assembly 28.

Figure 2:
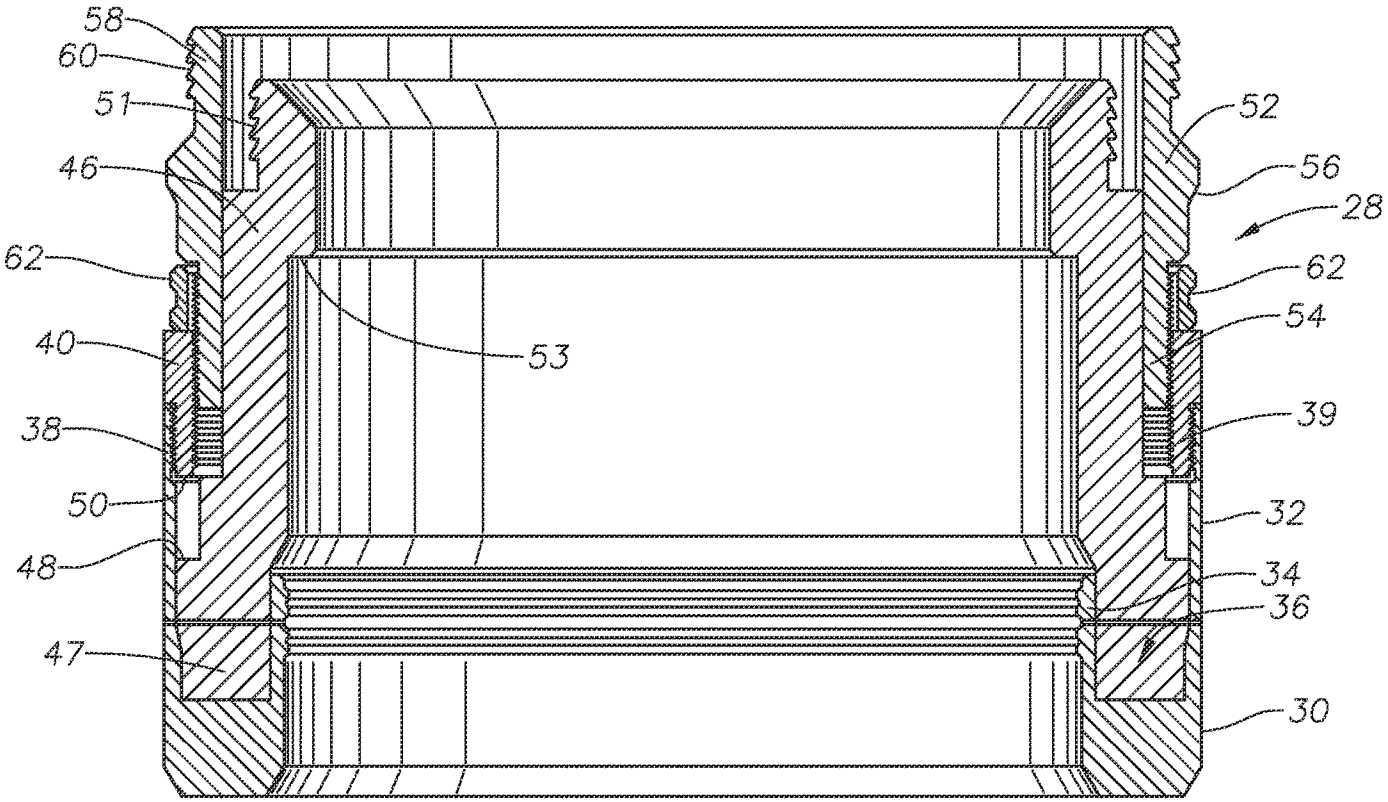
FIG. 2 is a section view of one of the seal assemblies of FIG. 1, shown with an annular lock ring in an unenergized position.

In the embodiments of FIGS. 1-3, seal energizing ring 46 has an energizing ring tool profile 51 for engaging an energizing ring installation tool during installation and energization of seal assembly 28. Seal energizing ring 46 also includes a downward facing annular shoulder 53 that can engage an upper end of inner tubular wellhead member 16.

Returning to FIGS. 1-4, lock energizing ring 52 circumscribes seal energizing ring 46 and is carried as a part of seal assembly 28 when seal assembly 28 is landed in seal pocket 22. Lock energizing ring 52 has lower threaded portion 54 that releasably secures lock energizing ring 52 to another component of seal assembly 28. Lock energizing ring has a bottom end that engages an upward facing annular shoulder of seal energizing ring 46. In the embodiments of FIGS. 2-3, lock energizing ring 52 has threads on an outer diameter of lower threaded portion 54 that engage threads on an outer diameter of annular gland 40. In the example of FIG. 4, lock energizing ring 52 instead has threads on an inner diameter of lower threaded portion 54 that engage threads on an outer diameter of seal energizing ring 46.

Looking again at FIGS. 1-4, lock energizing ring 52 has a profiled portion with sloped surface 56 on the outer diameter of the profiled portion. Sloped surface 56 is a generally downward facing annular shoulder. An upper profiled portion 58 has a lock ring tool profile 60 for engaging a lock ring tool during installation and energization of seal assembly 28.

Annular lock ring 62 is carried with seal energizing ring 46. Annular lock ring 62 can be a split ring and has ridge profile 62. Ridge profile 62 corresponds with and can mate with annular grooves of locking profile 15. The inner diameter and sloped surface 56 of lock energizing ring 52 retain annular lock ring 62 in engagement with locking profile 15. Annular lock ring 62 can be carried axially between an upper end surface of annular gland 40 and sloped surface 56 of lock energizing ring 52.

In an example of operation, lower end 47 of seal energizing ring 46 can be located between an upper end of inner and outer legs 32, 34 of seal ring 30 and annular gland 40 can be threaded onto extended portion 38 of outer leg 32 of seal ring 30 in order to retain seal energizing ring with seal ring 30. Lock energizing ring 52 can then be loosely threaded onto annular gland 40 or seal energizing ring 46, as applicable. Annular lock ring 62 is retained between upper end surface of annular gland 40 and sloped surface 56 of lock energizing ring 52. Annular lock ring 62 is separated from sloped surface 56 axially adjacent to a smaller diameter portion of lock energizing ring 52 so that an outer diameter of annular lock ring 62 is smaller than the inner diameter of bore 14 of outer wellhead member 16.

Seal assembly 28 can then be secured to a tool for lowering into wellhead assembly 10. In the embodiment of FIGS. 2-3, the energizing ring tool engages energizing ring tool profile 51 of seal energizing ring 46. In the example of FIG. 4, the lock ring tool engages lock ring tool profile 60 of lock energizing ring 52. Returning to FIGS. 1-4, seal assembly 28 can be lowered into an annulus or seal pocket 22, between inner tubular wellhead member 16 and outer wellhead member 12. A bottom end of seal assembly 28 can land on slips assembly 17.

Seal ring 30 can then be energized by urging seal ring 30 toward outer wellhead member 12 and inner tubular wellhead member 16 with seal energizing ring 46. This can be accomplished by inserting lower end 47 of seal energizing ring 46 between inner and outer legs 32, 34 of seal ring 30; inner leg 32 of seal ring 30 is urged radially into sealing engagement with inner tubular wellhead member 16 and outer leg 34 of seal ring 30 is urged radially into sealing engagement with outer wellhead member 12.

After seal ring 30 has been fully energized annular lock ring 62 can be moved from the unenergized position shown in FIG. 2, to the energized position shown in FIGS. 1 and 3-4. The lock ring tool can engage lock ring tool profile 60 of lock energizing ring 52 and rotate lock energizing ring 52 so that lock energizing ring 52 moves axially towards seal ring 30. As lock energizing ring 52 moves axially towards seal ring 30, the larger outer diameter portion of lock energizing ring 52 will force annular lock ring 62 radially outward and into engagement with locking profile 15 of outer wellhead member 12. Lock energizing ring 52 can continue to be rotated until the bottom end of lock energizing ring 52 engages an upward facing annular shoulder of seal energizing ring 46.

Lock energizing ring 52 will retain annular lock ring 62 in engagement with locking profile 15 of outer wellhead member 12. Thermal expansion, as well as other operational forces generated by, for example cyclic loads and internal pressure, will generate axial forces in inner tubular wellhead member 16. These forces will be transferred to seal energizing ring 46, through annular gland 40, and then to lock ring 62 and into outer wellhead member 12. In this manner, loads can be transferred from inner tubular wellhead member 16 to outer wellhead member 12 without allowing seal energizing ring 46 to back out of seal ring 30, and the seal formed by seal ring 30 will remain intact.

The terms "vertical", "horizontal", "upward", "downward", "above", and "below" are used herein only for convenience because elements of embodiments of this disclosure may be utilized in various positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A wellhead assembly with an axis, comprising:

an outer wellhead member, the outer wellhead member having a locking profile on an inner surface;

an inner tubular wellhead member, the inner tubular wellhead member being operable to land within the outer wellhead member, defining a seal pocket between the inner tubular wellhead member and the outer wellhead member;

a seal ring located in the seal pocket;

a seal energizing ring selectively urging the seal ring into sealing engagement with the outer wellhead member and the inner tubular wellhead member, an annular lock ring carried with the seal energizing ring, the annular lock ring selectively engaging the locking profile; and a lock energizing ring selectively retaining the annular lock ring in engagement with the locking profile and being threadingly coupled to mating threads of the seal energizing ring at a location proximate the annular lock ring.

2. The assembly according to claim 1, wherein the seal ring has a general U-shape in cross section.

3. The assembly according to claim 1, further comprising an annular gland secured to the seal ring, and wherein the annular lock ring directly engages an end surface of the annular gland.

4. The assembly according to claim 1, wherein:

an end of the inner tubular wellhead member selectively engages a downward facing shoulder of the seal energizing ring;

an annular gland is secured to the seal ring via a threaded connection positioned radially outward from the axis and proximate the outer wellhead member; and the annular gland is threaded to the lock energizing ring.

5. The assembly according to claim 1, wherein:

an end of the inner tubular wellhead member selectively engages a downward facing shoulder of the seal ring;

an annular gland is secured to the seal ring; and the lock energizing ring is threaded to the seal energizing ring.

6. The assembly according to claim 1, wherein the seal ring has an outer leg and an inner leg, the outer leg having a greater axial height than the inner leg, and wherein an annular gland is secured to the outer leg.

7. The assembly according to claim 1, wherein the lock energizing ring has a bottom end that selectively engages an upward facing annular shoulder of the seal energizing ring.

8. The assembly according to claim 1, wherein the seal energizing ring has an energizing ring tool profile for engaging an energizing ring installation tool, and the lock energizing ring has a lock ring tool profile for engaging a lock ring installation tool.

9. The assembly according to claim 1, wherein the locking profile comprises annular grooves and the annular lock ring has a ridge profile that mates with the annular grooves.

10. A wellhead assembly with an axis, comprising:

an outer wellhead member, the outer wellhead member having a locking profile on an inner surface;

an inner tubular wellhead member, the inner tubular wellhead member being operable to land within the outer wellhead member, defining a seal pocket between the inner tubular wellhead member and the outer wellhead member;

a seal ring located in the seal pocket, the seal ring having a U-shaped cross section with an inner leg and an outer leg;

a seal energizing ring having an end selectively located between the inner leg and the outer leg of the seal ring, urging the outer leg into sealing engagement with the outer wellhead member and urging the inner leg into engagement with the inner tubular wellhead member, an annular gland circumscribing a portion of the seal energizing ring;

a lock energizing ring circumscribing a portion of the seal energizing ring, the lock energizing ring positioned radially outward from the seal energizing ring and threadingly coupled directly to the annular gland; and an annular lock ring, the annular lock ring located axially between an upper end surface of the annular gland and a sloped surface of the lock energizing ring, wherein the annular lock ring selectively engages the locking profile, transferring axial forces of the inner tubular wellhead member to the outer wellhead member.

11. The assembly according to claim 10, wherein an end of the inner tubular wellhead member engages a downward facing shoulder of the seal energizing ring.

12. The assembly according to claim 10, wherein an end of the inner tubular wellhead member engages a downward facing shoulder of the seal ring and the lock energizing ring is threaded to the seal energizing ring.

13. The assembly according to claim 10, wherein the outer leg of the seal ring has a greater axial height than the inner leg of the seal ring, and wherein the annular gland is secured to the outer leg.

14. The assembly according to claim 10, wherein the seal energizing ring has an energizing ring tool profile for engaging an energizing ring installation tool, and the lock energizing ring has a lock ring tool profile for engaging a lock ring installation tool.

15. A method for forming a seal between an inner tubular wellhead member and an outer wellhead member, the method comprising:

(a) positioning an annular seal ring in a seal pocket between the inner tubular wellhead member and the outer wellhead member;

(b) energizing the seal ring by urging the seal ring toward the outer wellhead member and the inner tubular wellhead member with a seal energizing ring; and (c) rotating a lock energizing ring to engage an annular lock ring arranged radially outward from the lock energizing ring with a locking profile located on an inner surface of the outer wellhead member, the lock energizing ring directly coupling to and threadingly securing an annular gland axially below the annular lock ring.

16. The method according to claim 15, wherein the seal ring has a U-shaped cross section with an inner leg and an outer leg, and wherein step (b) includes urging the outer leg into sealing engagement with the outer wellhead member and urging the inner leg into engagement with the inner tubular wellhead member.

17. The method according to claim 15, wherein step (c) includes rotating the lock energizing ring to thread the lock energizing ring with an annular gland that is secured to the seal ring.

18. The method according to claim 15, wherein step (c) includes rotating the lock energizing ring to thread the lock energizing ring with the seal energizing ring.

19. The method according to claim 15, wherein:

step (b) includes urging the seal ring with an energizing ring tool that engages an energizing ring tool profile of the seal energizing ring; and step (c) includes rotating the lock energizing ring with a lock ring installation tool that engages a lock ring tool profile of the lock energizing ring.

20. The method according to claim 15, wherein the annular lock ring is a split ring and step (c) includes urging an outer profile of the annular lock ring radially outward with an outer diameter of the lock energizing ring by rotating the lock energizing ring until a bottom end of the lock energizing ring engages an upward facing annular shoulder of the seal energizing ring.

* * * * *